US009458609B2

(12) United States Patent
Fleury, Jr. et al.

(10) Patent No.: US 9,458,609 B2
(45) **Date of Patent: *Oct. 4, 2016**

(54) FLUSHING HYDRANT

(71) Applicant: Mueller International, LLC, Atlanta, GA (US)

(72) Inventors: Leo W. Fleury, Jr., N. Smithfield, RI (US); Normand James Roy, Coventry, RI (US); James Ola Williams, Marlborough, MA (US); Kenneth A. Clark, Chattanooga, TN (US); Edward C. Parish, North Reading, MA (US)

(73) Assignee: Mueller International, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/760,804

(22) Filed: Feb. 6, 2013

(65) Prior Publication Data

US 2013/0199625 A1 Aug. 8, 2013

Related U.S. Application Data

(60) Provisional application No. 61/595,737, filed on Feb. 7, 2012.

(51) Int. Cl.
*E03B 9/02* (2006.01)
*E03B 9/16* (2006.01)

(52) U.S. Cl.
CPC . *E03B 9/02* (2013.01); *E03B 9/16* (2013.01); *Y10T 137/0424* (2015.04); *Y10T 137/4245* (2015.04)

(58) Field of Classification Search
CPC ..... E03B 7/12; E03B 9/02; E03B 9/14; A62C 35/20
USPC ..... 137/238, 282, 288, 291, 296, 62, 63.6; 169/11, 16, 17, 61, 71; 134/166 C, 134/22.11, 22.12
See application file for complete search history.

(56) References Cited

U.S. PATENT DOCUMENTS 2,262,489 A 11/1941 Bolser
2,580,197 A * 12/1951 Schmid ..... E03B 9/14 137/292

(Continued)

OTHER PUBLICATIONS

Fleury, Jr., Leo W.; Provisional Patent Application Entitled: Flushing Hydrant, U.S. Appl. No. 61/595,737, filed Feb. 7, 2012; 19 pgs.

(Continued)

*Primary Examiner* — Craig Schneider
*Assistant Examiner* — Kevin Barss
(74) *Attorney, Agent, or Firm* — Taylor English Duma LLP

(57) ABSTRACT

A device for flushing a hydrant includes a stem connected to a valve of the hydrant; and an actuation system including a biased translational system coupled to the stem. An actuation system for flushing a hydrant includes a fluid; a piston assembly movable by the fluid; and a biasing element at least indirectly biasing the piston assembly towards a stop position. A method of flushing a hydrant includes operating an actuation system coupled to the hydrant, the actuation system including a stored energy device, a piston assembly coupled to a stem of the hydrant; and a biasing element coupled to the stem, the stem connected to a valve of the hydrant; and opening the valve of the hydrant by releasing energy from the stored energy device against a piston plate of the piston assembly.

20 Claims, 8 Drawing Sheets

(56) References Cited

U.S. PATENT DOCUMENTS

| | | | | |
|---|---|---|---|---|
| 3,566,905 | A | 3/1971 | Noland | |
| 3,961,642 | A | 6/1976 | Thomas et al. | |
| 4,561,459 | A * | 12/1985 | Jackman | 137/291 |
| 4,706,929 | A * | 11/1987 | Kalaskie et al. | 251/14 |
| 4,989,830 | A * | 2/1991 | Ratnik | 251/129.11 |
| 5,201,338 | A * | 4/1993 | McKeague | 137/238 |
| 5,547,164 | A * | 8/1996 | Ratnik | E03B 9/02 251/129.03 |
| 5,921,270 | A * | 7/1999 | McCarty | 137/240 |
| 6,129,002 | A | 10/2000 | Lisec et al. | |
| 6,356,811 | B1 | 3/2002 | Beselt | |
| 6,467,498 | B1 * | 10/2002 | Esmailzadeh | 137/238 |
| 6,627,089 | B1 * | 9/2003 | Wilkinson | 210/754 |
| 6,820,635 | B1 * | 11/2004 | McKeague | 137/299 |
| 6,868,860 | B2 * | 3/2005 | Davidson | 137/299 |
| 6,948,512 | B2 * | 9/2005 | McKeague | 137/15.05 |
| 7,473,359 | B1 * | 1/2009 | Barrett, II | 210/232 |
| 7,509,972 | B2 * | 3/2009 | Nesbitt | F16K 35/06 137/383 |
| 9,194,108 | B2 * | 11/2015 | Fleury, Jr. | E03B 9/02 |
| 2002/0024033 | A1 * | 2/2002 | Burkhardt | 251/14 |
| 2006/0027265 | A1 | 2/2006 | Ball et al. | |
| 2007/0075162 | A1 * | 4/2007 | McKeague | 239/104 |
| 2009/0178721 | A1 | 7/2009 | Thompson | |
| 2010/0032600 | A1 | 2/2010 | Doe et al. | |
| 2010/0065287 | A1 * | 3/2010 | Burkhart et al. | 169/17 |
| 2010/0121496 | A1 | 5/2010 | Paulus et al. | |
| 2010/0163765 | A1 * | 7/2010 | Gregoire | 251/62 |
| 2010/0193715 | A1 | 8/2010 | Gethmann | |
| 2010/0282225 | A1 * | 11/2010 | Gilbert | F01L 9/026 123/70 R |

OTHER PUBLICATIONS

Fleury, Jr., Leo W.; PCT Application entitled: Flushing Hydrant having serial No. PCT/US13/24928, filed Feb. 6, 2013, 27 pgs.

Fleury, Jr., Leo W.; U.S. Patent Application entitled: Flushing Hydrant With Fail-Safe, U.S. Appl. No. 13/841,597, filed Mar. 15, 2013; 37 pgs.

Fleury, Leo W.; International Search Report and Written Opinion for serial No. PCT/US2013/024928, filed Feb. 6, 2013, mailed Apr. 5, 2013, 10 pgs.

Fleury, Leo W.; PCT Application entitled: Flushing Hydrant with Fail-Safe having serial No. PCT/US14/19315, filed Feb. 28, 2014, 38 pgs.

Fleury Jr., Leo W.; Non-Final Office Action for U.S. Appl. No. 13/841,597, filed Mar. 15, 2013, mailed Nov. 3, 2014, 33 pgs.

Fleury Jr., Leo W.; Restriction Requirement for U.S Appl. No. 13/841,597, filed Mar. 15, 2013, mailed Sep. 11, 2014, 6 pgs.

Fleury Jr., Leo W.; International Preliminary Report on Patentability for serial No. PCT/US2013/024928, filed Feb. 6, 2013, mailed Aug. 21, 2014, 9 pgs.

Fleury Jr., Leo W.; International Search Report and Written Opinion for serial No. PCT/US14/19315, filed Feb. 28, 2014, mailed Sep. 2, 2014, 12 pgs.

Fleury Jr., Leo W.; Final Office Action for U.S. Appl. No. 13/841,597, filed Mar. 15, 2013, mailed Apr. 14, 2015, 18 pgs.

Fleury Jr., Leo W.; Issue Notification for U.S. Appl. No. 13/841,597, filed Mar. 15, 2013, mailed Nov. 4, 2015, 1 pg.

Fleury Jr., Leo W.; Notice of Allowance for U.S. Appl. No. 13/841,597, filed Mar. 15, 2013, mailed Aug. 26, 2015, 10 pgs.

Fleury Jr., Leo W.; Supplemental Notice of Allowability for U.S. Appl. No. 13/841,597, filed Mar. 15, 2013, mailed Oct. 9, 2015, 4 pgs.

Fleury Jr., Leo W.; International Preliminary Report on Patentability for PCT/US14/19315, filed Feb. 28, 2014, mailed Sep. 24, 2015, 9 pgs.

* cited by examiner

FLUSHING HYDRANT

CROSS-REFERENCE TO RELATED APPLICATIONS

This application claims the benefit of U.S. Provisional Application 61/595,737, filed on Feb. 7, 2012, which is hereby incorporated herein in its entirety by reference.

FIELD

The current disclosure relates to fire hydrants. Particularly, the current disclosure relates to flushing of fire hydrants.

SUMMARY

A device for flushing a hydrant is disclosed and includes a stem connected to a valve of the hydrant; and an actuation system including a biased translational system coupled to the stem.

Also disclosed is an actuation system for flushing a hydrant including a fluid; a piston assembly movable by the fluid; and a biasing element at least indirectly biasing the piston assembly towards a stop position.

Also disclosed is a method of flushing a hydrant including operating an actuation system coupled to the hydrant, the actuation system including a stored energy device, a piston assembly coupled to a stem of the hydrant; and a biasing element coupled to the stem, the stem connected to a valve of the hydrant; and opening the valve of the hydrant by releasing energy from the stored energy device against a piston plate of the piston assembly.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity. Although dimensions may be shown in some figures, such dimensions are exemplary only and are not intended to limit the disclosure.

DETAILED DESCRIPTION

Disclosed are methods, systems, and apparatus associated with flushing fire hydrants. The disclosure provides apparatus, methods, and systems for flushing a fire hydrant. The fire hydrant in various embodiments may be flushed using a fluid actuation system. The fire hydrant in various embodiments may be flushed from a remote location using a remote communicator.

It is common in municipal water systems to flush water through fire hydrants to ensure adequate flow and pressure to the hydrants and to remove sediment from the piping system. Often, this can be a labor-intensive task, requiring technicians to go into the field to perform the flushing operation for each hydrant in the piping system.

Most standard fire hydrants in the United States of America and in many other parts of the world are "dry barrel hydrants," meaning that the hydrant itself contains no water. Because fire hydrants are above-ground apparatus, a hydrant full of water could freeze and crack. Instead, water is flushed into the hydrant when it is needed.

Figure 1:
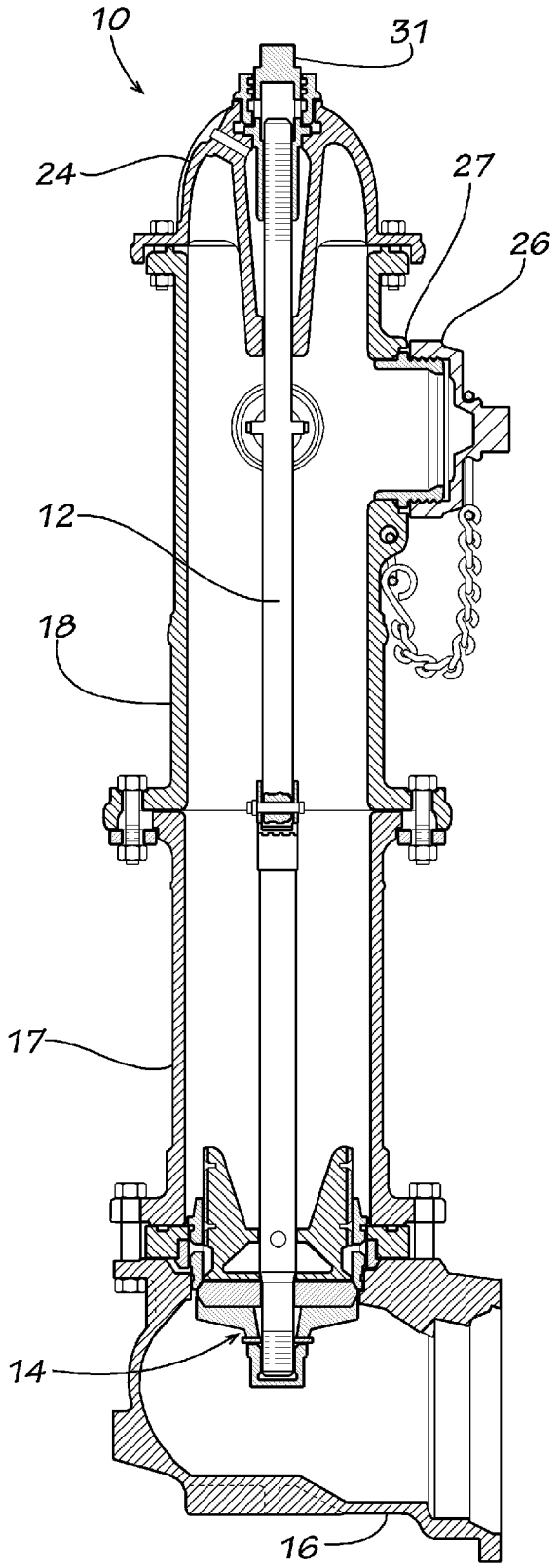
FIG. 1 is a cross-sectional view of a standard fire hydrant.

Standard fire hydrants, such as standard fire hydrant 10, seen in FIG. 1, contain a stem 12 that connects to a valve 14 in a shoe 16. The shoe 16 is connected to a lower barrel 17. The lower barrel 17 is connected to the upper barrel 18. The upper barrel 18 is connected to a bonnet 24. A nozzle 27 is also seen on the upper barrel 18. The shoe 16 is in fluid communication with a water supply system, which is typically a municipal water supply. When water is needed or when the standard fire hydrant 10 needs to be opened to flush the water system, an operating nut 31 attached to the stem 12 is actuated to open the valve 14, thereby allowing water to flow into the lower barrel 17 and the upper barrel 18. A nozzle cap 26 can be removed to allow water to flush through the standard fire hydrant 10 or to provide water for firefighting or for other purposes. Typically, when a flushing operation is desired, a diffuser is connected to the nozzle 27 to reduce the velocity of the water stream exiting the standard fire hydrant 10, although a diffuser may not be necessary in all applications.

Figure 2:
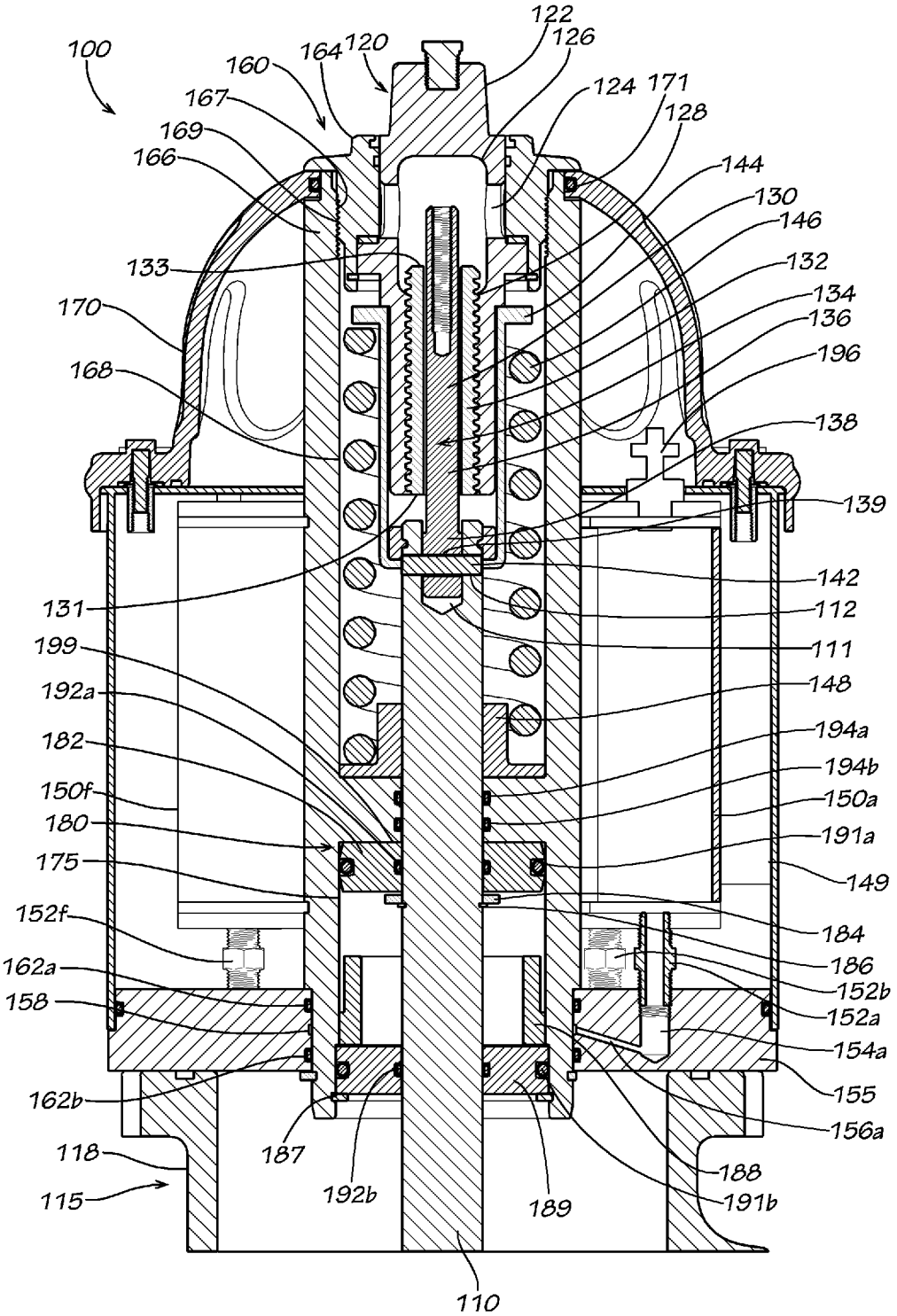
FIG. 2 is a cross-sectional view of a flushable hydrant in accord with one embodiment of the current disclosure in a resting state.

FIG. 2 is a cross-sectional view of a flushable hydrant 100 in accord with one embodiment of the current disclosure. The flushable hydrant 100 of the current embodiment includes an assembly of various pieces that permits electronic flushing of the flushable hydrant 100. In various embodiments, the flushable hydrant 100 includes an actuation system that includes a biased translational system for automated opening while maintaining a rotational manual override.

Seen in FIG. 2, much like a standard fire hydrant, the flushable hydrant 100 includes a stem 110 that communicates with a valve (not shown) to allow water to flush from a lower barrel (not shown) of a hydrant body 115 into an upper barrel 118 of the hydrant body 115. To do this, an operating nut 120 is rotated thereby causing actuation of the stem 110. The operating nut 120 includes an interface portion 122 and a body portion 124. The body portion 124 includes a cavity 126, which includes internal threading 128. The internal threading 128 interacts with a plunger assembly 130. The plunger assembly 130 includes a threaded actuator 132 sheathing a piston 134. The threaded actuator 132 is not mechanically coupled to the piston 134 but instead is allowed to move freely up and down in the current view. The threaded actuator defines a square bore 133 and has a contact end 131. The square bore 133 is square in cross-section. The piston 134 includes an upper portion 136 and a lower portion 138. The lower portion 138 defines a bore 139, which will be discussed later. Although only a cross-sectional view is shown, the upper portion 136 is square in cross-section so that the threaded actuator 132 does not rotate when the operating nut 120 rotates. Instead, the threaded actuator 132 translates downward in the current view thereby manually opening the valve (not shown). A coupling countersink 111 is seen in the stem 110. The lower portion 138 fits into the coupling countersink 111 and is shown inserted therein. The stem 110 defines a bore 112. A coupling shear pin 142 is inserted through both the bore 112 and the bore 139 to couple the plunger assembly 130 with the stem 110.

The foregoing paragraphs describe a manual override system of the flushable hydrant 100 that allow the flushable hydrant 100 to be operated externally by an operator such as a fireman or technician. As such, the flushable hydrant 100 can be used in the same application as prior art fire hydrants. However, the flushable hydrant 100 is also operable by other means, as described below.

Coupled to the stem 110 is a top stop 144. The top stop 144 provides bracing for one end of a biasing element 146. In the current embodiment, the biasing element 146 is a helical spring, although it may be various types of biasing elements in various embodiments, including various types of springs, magnetic biasing, electromechanical biasing such as servomotor-actuation, electromagnetic biasing such as solenoid-actuation, and gravitational biasing, among others. The biasing element 146 is braced on its other end to a bottom stop 148. Because the top stop 144 is coupled to the stem 110, the biasing element 146 biases the flushable hydrant 100 to the closed position, as shown in FIG. 2.

As can be seen, the flushable hydrant 100 includes a shroud 149. The shroud 149 of the current embodiment is made of steel that is 0.100 inches in thickness, although various materials and thicknesses may be used in various embodiments. The flushable hydrant 100 includes six compressed gas containers 150*a,b,c,d,e,f* (150*b,c,d,e* not shown). In various embodiments, various numbers, shapes, and configurations of compressed gas containers 150 may be used. In one exemplary embodiment, the shroud 149 is used as a compressed gas container 150 such that compressed gas fills the entire volume encompassed by the shroud. Such a configuration would obviate the need for separate compressed gas containers 150. Other fluid media may be used in the system of the current embodiment aside from compressed gas. Compressed gas is intended solely as an exemplary embodiment. Additionally, myriad variations on the systems, methods, and apparatus of the current embodiment may be used in various embodiments, including variations that may obviate the need for a fluid system, in some embodiments.

Each compressed gas container 150*a,b,c,d,e,f* is designed to hold a predetermined volume of compressed gas at a predetermined pressure. All of the compressed gas containers 150*a,b,c,d,e,f* are in fluid communication with one another such that the compressed gas containers 150*a,b,c,d,e,f* act as a single container, although various embodiments may include various different configurations.

Fittings 152*a,b,c,d,e,f* provide a fluid communication route from each compressed gas container 150*a,b,c,d,e,f* to gas bores 154*a,b,c,d,e,f* in a hydrant seal plate 155, respectively. Each fitting 152*a,b,c,d,e,f* in the current embodiment is made of brass, although other materials or configurations may be used. Each gas bore 154*a,b,c,d,e,f* is in fluid communication with a vein 156*a,b,c,d,e,f*, respectively, which connects to an annulus groove 158. Because all of the veins 156*a,b,c,d,e,f* are in fluid communication with the same annulus groove 158, compressed gas may move between the compressed gas containers 150*a,b,c,d,e,f* to equalize pressure therein. Annular gaskets 162*a,b* are seen sealing the annulus groove 158.

A hold down assembly 160 includes a hold down nut 164 and a stem body 166. The hold down nut 164 is connected by threading 167 to threading 169 of the stem body 166. The hold down assembly 160 sandwiches a bonnet 170 of the flushable hydrant 100. The connection of the hold down assembly 160 and the bonnet 170 is sealed by a gasket 171.

The stem body 166 defines a bias cavity 168 inside which the previously-mentioned biasing element 146 is seated. The stem body 166 also defines a pressure cavity 175. Within the pressure cavity 175 is a piston assembly 180. The piston assembly 180 includes a piston plate 182, a washer 184, a washer stop 186, a cylinder body 188, a bottom plate 189, and a bottom plate stop 187. In some embodiments, the bottom plate 189 and cylinder body 188 may be one piece. Annular gaskets 191*a,b* and 192*a,b* seal the space between the piston plate 182 and the bottom plate 189. Piston gaskets 194*a,b* seal a piston void 199 defined within the space between the piston plate 182 and the stem body 166 on the opposing side of the piston plate 182 from the bottom plate 189. The piston void 199 as shown has no volume. When the piston plate 182 moves, the piston void 199 becomes larger. The purpose of the piston gaskets 194*a,b* will become apparent below with reference to FIG. 3.

A fill port 196 can also be seen connected to the top of compressed gas container 150*a*. The fill port 196 allows the compressed gas containers 150*a,b,c,d,e,f* to be filled with compressed gas.

Figure 3:
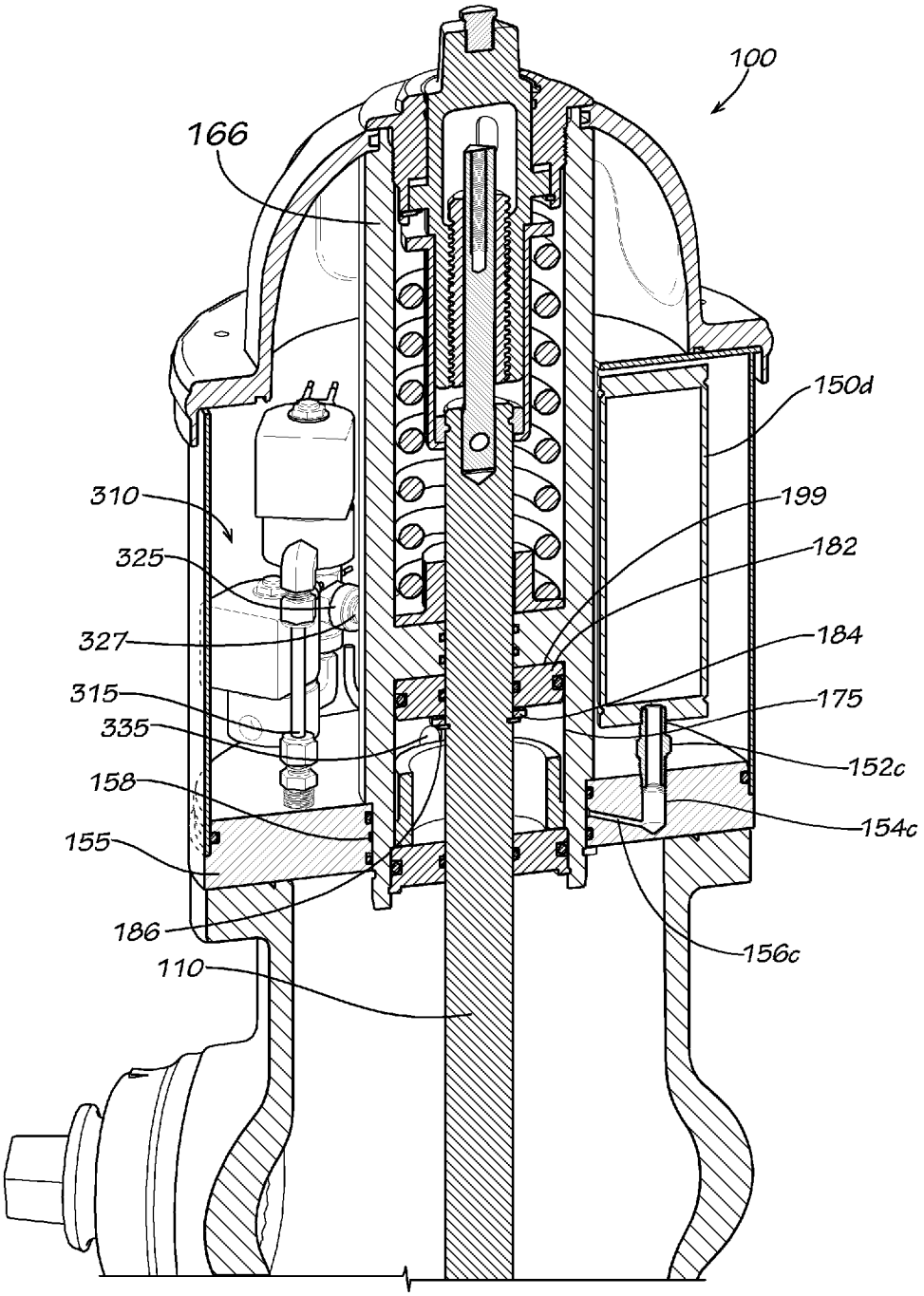
FIG. 3 is a cutaway view of the flushable hydrant of FIG. 2 taken along a different cutting plane from FIG. 2.

As seen in FIG. 3, the cutting plane of the flushable hydrant 100 is orthogonal to the cutting plane of FIG. 2. A pressure regulation assembly 310 can be seen in the current view. An annulus connection line 315 connects through a bore in the hydrant seal plate 155 to the annulus groove 158. As such, the annulus connection line 315 is in fluid communication with the annulus groove 158. The pressure regulation assembly 310 also includes a piston void line 325 that connects through a fitting 327 to the stem body 166. The stem body 166 includes a fill port 410 (not shown) leading to the piston void 199. A proximity sensor 335 can be seen in the pressure cavity 175. The pressure regulation assembly 310 also includes other features and apparatus (as will be described below) that allow the regulation of pressure through the pressure regulation assembly 310. The pressure regulation assembly 310 controls the amount of gas that flows from the annulus connection line 315 to the piston void line 325.

In operation, the flushable hydrant 100 can be actuated using the manual process described above. The flushable hydrant 100 can also be actuated by an actuation system. The actuation system may be connected to a remote communicator in various embodiments. One embodiment of an actuation system is described below, although one of skill in the art would understand that various elements may be altered or substituted in various modifications to the disclosure below without being considered outside the scope of the disclosure.

The stem 110 is capable of automatic actuation using the actuation system. The actuation system includes energy stored in the form of compressed gas, although various forms of stored energy may be used in various embodiments, including batteries, biasing elements such as springs and elastic, stored gravitational energy, mechanical batteries and flywheels, shape memory energy, and electromechanical storage, among other types of stored energy. Actuating the stem 110 using compressed gas is controlled by the pressure regulation assembly 310. The pressure regulation assembly 310 may include a wireless communication module or another communication module in various embodiments. The pressure regulation assembly 310 receives instructions to open the flushable hydrant 100. In response, the pressure regulation assembly 310, which is connected in fluid communication by the annulus connection line 315 to the annulus groove 158. The annulus groove 158 is connected to each vein 156*a,b,c,d,e,f*. Each vein 156*a,b,c,d,e,f* is connected to each gas bore 154*a,b,c,d,e,f*. Each gas bore 154*a,b,c,d,e,f* is connected to by each fitting 152*a,b,c,d,e,f* to each compressed gas container 150*a,b,c,d,e,f*. The piston void line 325 connects the pressure regulation assembly 310 in fluid communication to the piston void 199. Thus, the pressure regulation assembly 310 controls the release of compressed gas from the compressed gas containers 150*a,b,c,d,e,f* to the piston void 199.

In operation, the pressure regulation assembly 310 is opened to allow compressed gas to travel from the compressed gas containers 150*a,b,c,d,e,f* to the piston void 199. As pressure of the compressed gas in the compressed gas containers 150*a,b,c,d,e,f* is released into the piston void 199, the increased pressure in the piston void 199 is applied to the surface area of the piston plate 182. Pressure applied to an area creates a force on the piston plate 199 which is translated into the washer 184 and, thereby, into the washer stop 186. The force on the washer stop 186 is translated into the stem 110 resulting in a downward force on the stem 110.

As the compressed gas flowing from the compressed gas containers 150*a,b,c,d,e,f* to the piston void 199 increases, the downward force on the stem 110 increases. Eventually, the force on the stem 110 overcomes the closing pressure of the valve (not shown), causing the valve to open. When the valve opens, water is allowed to flush into and through the flushable hydrant 110. As such, the actuation system operates as a biased translational system in the current embodiment. Various embodiments of biased translational systems may also be used in various embodiments.

Figure 4:
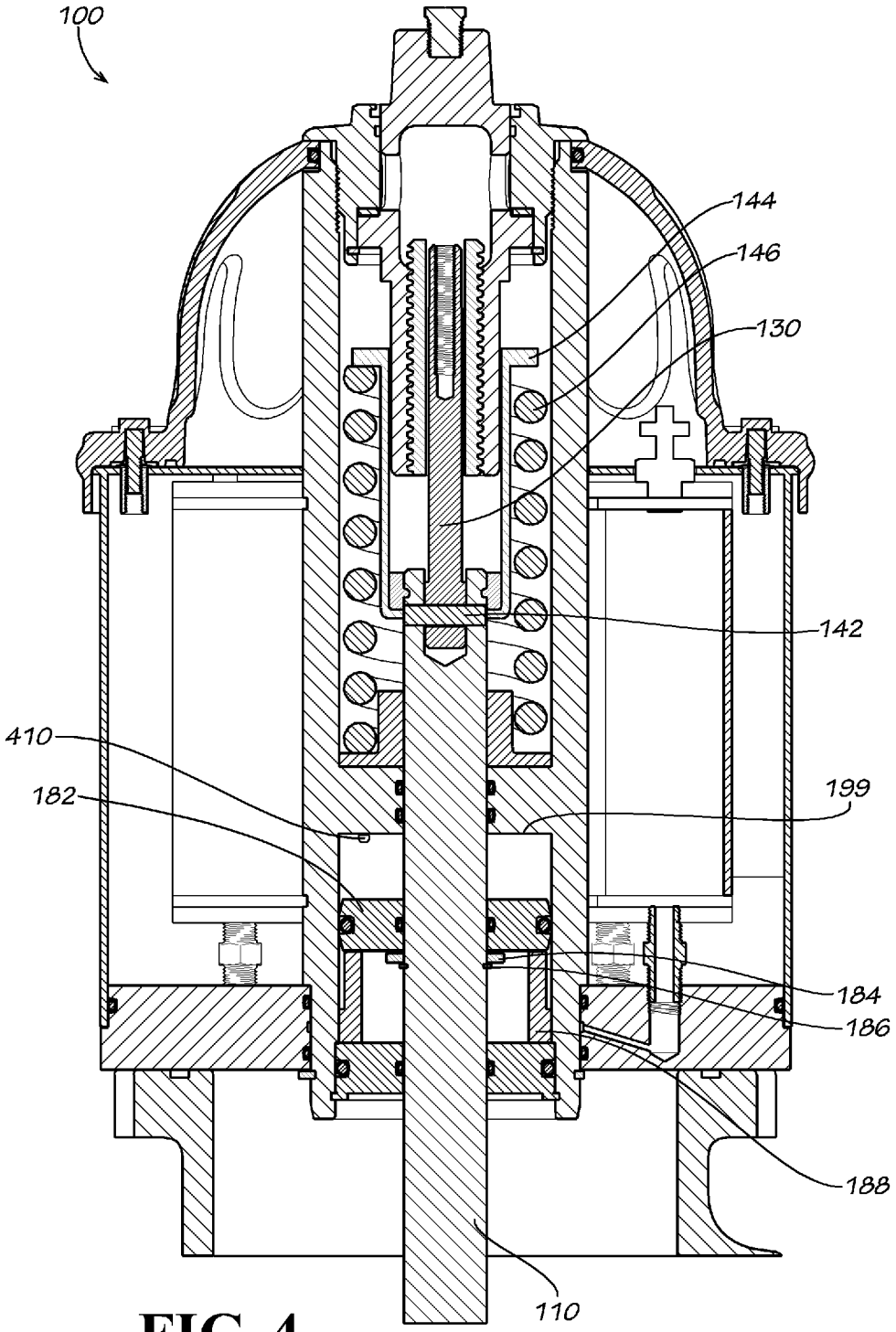
FIG. 4 is a cross-sectional view of the flushable hydrant of FIG. 2 in an actuated position.

To open the valve, the stem 110 moves downward as shown in FIG. 4. In the current view, the fill port 410 can be seen in the piston void 199. The proximity sensor 355 (not shown) is covered by the piston plate 182 which causes the pressure regulation assembly 310 to close the gas pathway from the compressed gas containers 150*a,b,c,d,e,f* to the piston void 199.

As can be seen, the biasing element 146 has compressed, thereby storing energy. The top stop 144 has moved downward in the view because it is connected to the stem 110, as is the coupling shear pin 142, the piston 182, the washer 184, and the washer stop 186. In the current embodiment, all of these parts have moved until the piston plate 182 contacts the cylinder body 188 and the cylinder body 188 provides a mechanical stop. Other embodiments many include various configurations for stops. It should be noted that no other parts or subassemblies of the flushable hydrant 100 have moved in the current embodiment, although various configurations may be present in various embodiments.

Figure 5:
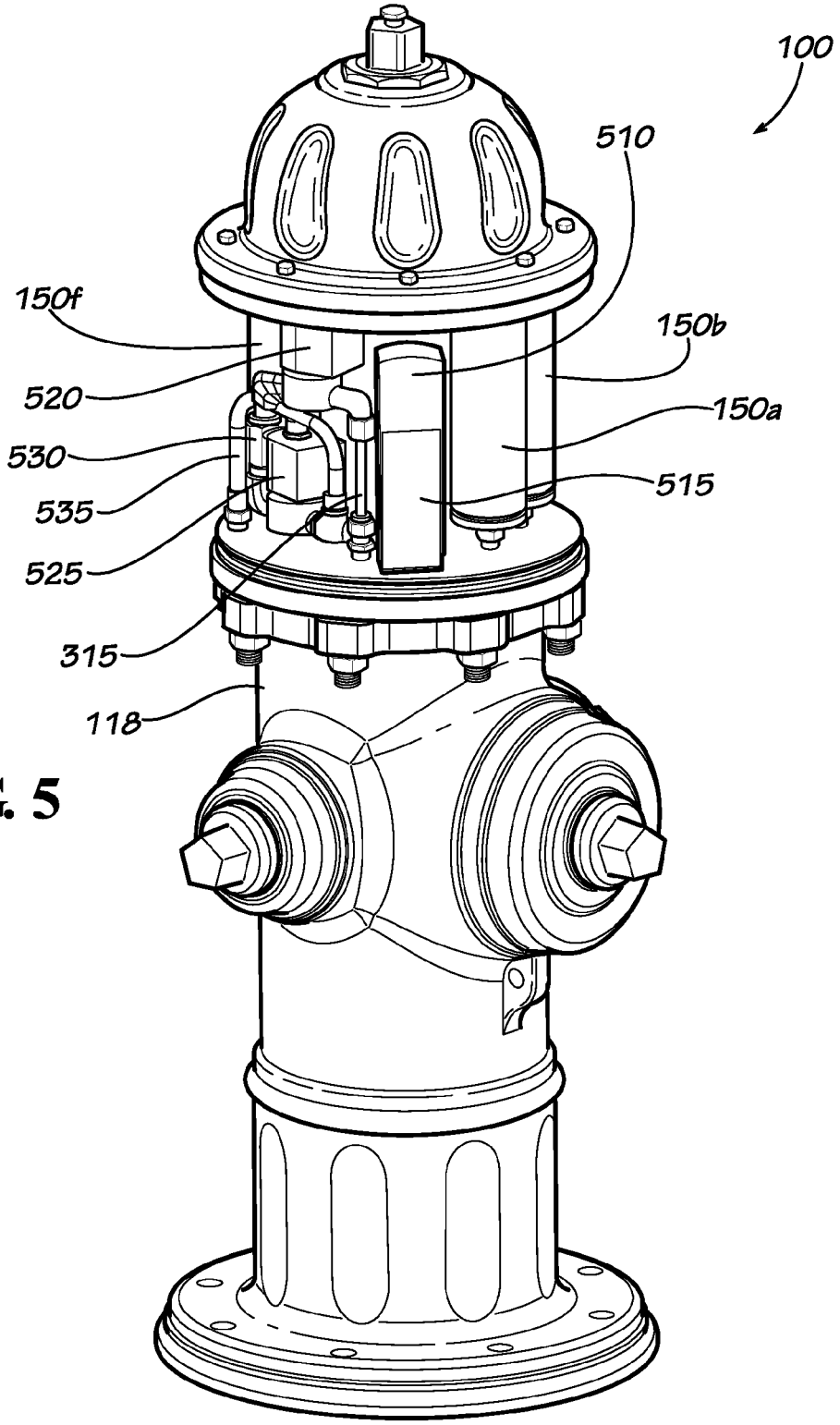
FIG. 5 is a perspective view of the flushable hydrant of FIG. 2 without a shroud.

FIG. 5 shows a perspective view of the flushable hydrant 100. Compressed gas containers 150*a,b,f* can be seen in the view (150*c,d,e* are hidden from view). A battery 510 is held in place by a battery bracket 515. An inflow valve 520 and an outflow valve 525 can be seen. Although an inflow valve 520 and an outflow valve 525 are used in the current embodiment, various types of pressure regulation mechanisms, systems, and methods may be used in various embodiments. Between the inflow valve 520 and the outflow valve 525 is a tee joint 530. The tee joint 530 is connected on one side to the inflow valve 520, on one side to the outflow valve 525, and on one side to the piston void line 325 (shown in FIG. 3). The inflow valve 520 and outflow valve 525 control the system.

Before any flushing takes place, pressure in the compressed gas containers 150*a,b,c,d,e,f* is at its highest, and there is no pressurization in the piston void 199. To open the valve (not shown), as previously described, the outflow valve 525 closes and the inflow valve 520 opens. As such, the pressure in the piston void 199 increases until the force exerted on the piston plate 182 overcomes the closing pressure of the valve (not shown) at which point the valve opens. As previously described, pressure in the compressed gas containers 150*a,b,c,d,e,f* is much greater than necessary to open the valve (not shown). As such, when the proximity sensor 355 recognizes that the piston plate 182 has moved to open the valve (not shown), the inflow valve 520 closes. This feature helps preserve compressed gas in the compressed gas containers 150*a,b,c,d,e,f* because it may not be necessary for the pressure to equalize fully from the compressed gas containers 150*a,b,c,d,e,f* to the piston void 199 in order to open the valve (not shown). Preserving compressed gas allows more flushing cycles to occur without refilling the compressed gas containers 150*a,b,c,d,e,f*.

Once water flushes into the flushable hydrant 100, the pressure inside the upper barrel 118 equalizes with the system pressure. Thus, water in the system provides no closing pressure on the valve (not shown). Instead, closing pressure on the valve (not shown) is provided by the biasing element 146, which becomes compressed due to the force on the piston plate 182.

When it is desired to close the valve (not shown), the outflow valve 525 is opened while the inflow valve 520 remains closed. The exhaust line 535 vents to outside air. Without closed pressure in the piston void 199, compressed gas is allowed to flow through an exhaust line 535 that is connected to the outflow valve 525. The pressure in the piston void 199 is released, thereby relieving the downward force on the piston plate 182. The release of the downward force allows the biasing element 146 to lift the stem 110 and, thereby, to close the valve (not shown).

Figure 6:
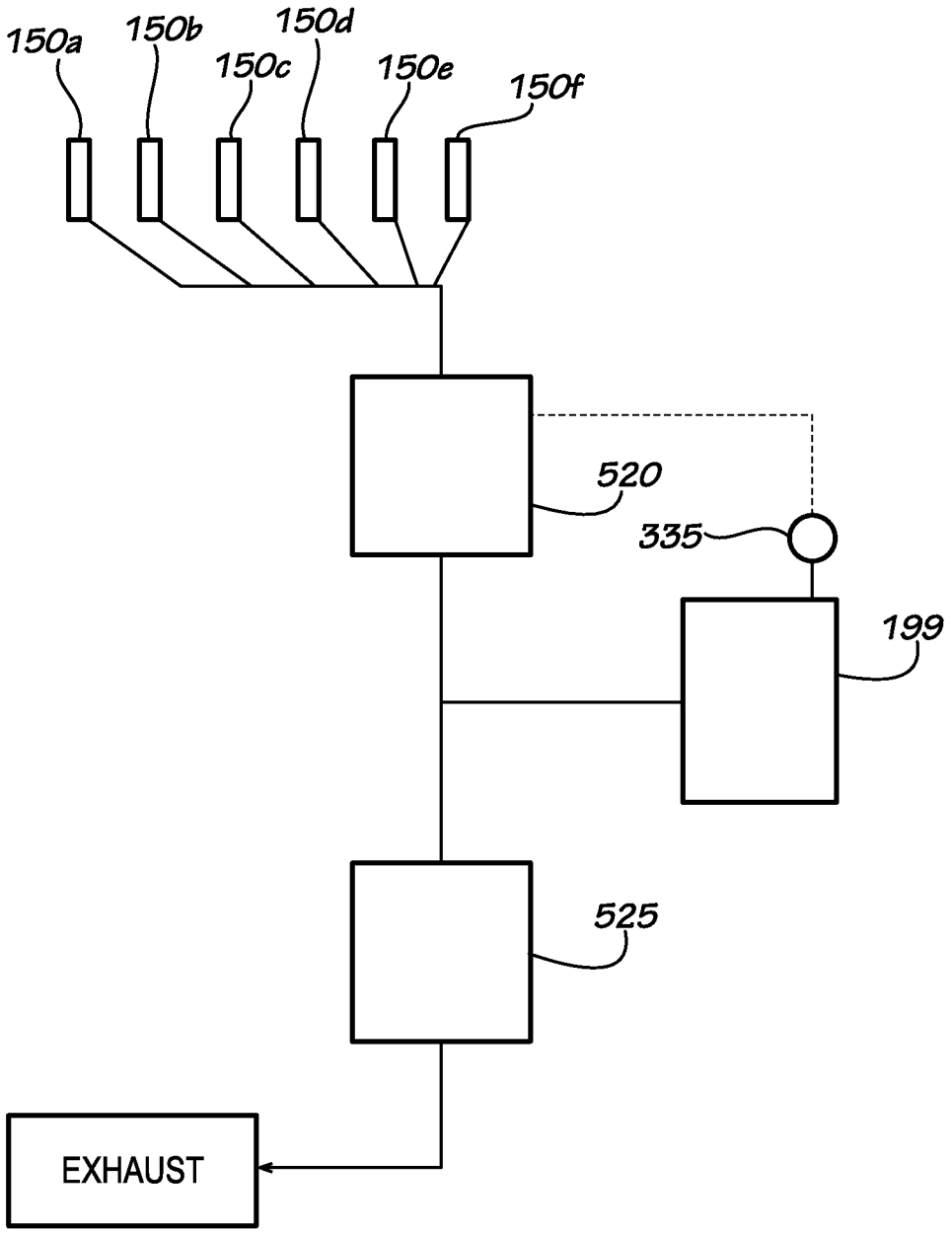
FIG. 6 is a schematic representation of a compressed gas system of the flushable hydrant of FIG. 2.

FIG. 6 displays a schematic representation of the compressed gas system of the flushable hydrant 100. In the current embodiment, the compressed gas containers 150*a,b,c,d,e,f* are in fluid communication with each other and are connected to the inflow valve 520. The inflow valve 520 maintains any compressed gas in the compressed gas containers 150*a,b,c,d,e,f* until operation of the flushable hydrant 100 is desired as described above. When the flushable hydrant 100 is operated, the outflow valve 525 closes and the inflow valve 520 opens. This allows compressed gas to flow into the piston void 199. When the proximity sensor 335 is activated as described above, the proximity sensor 335 sends a signal to the inflow valve 520 to close, cutting the flow of compressed gas from the compressed gas containers 150*a,b,c,d,e,f* to the piston void 199. When it is desired to return the flushable hydrant 100 to resting state, the outflow valve 525 is opened, allowing compressed gas in the piston void 199 to escape and to exhaust.

Figure 7:
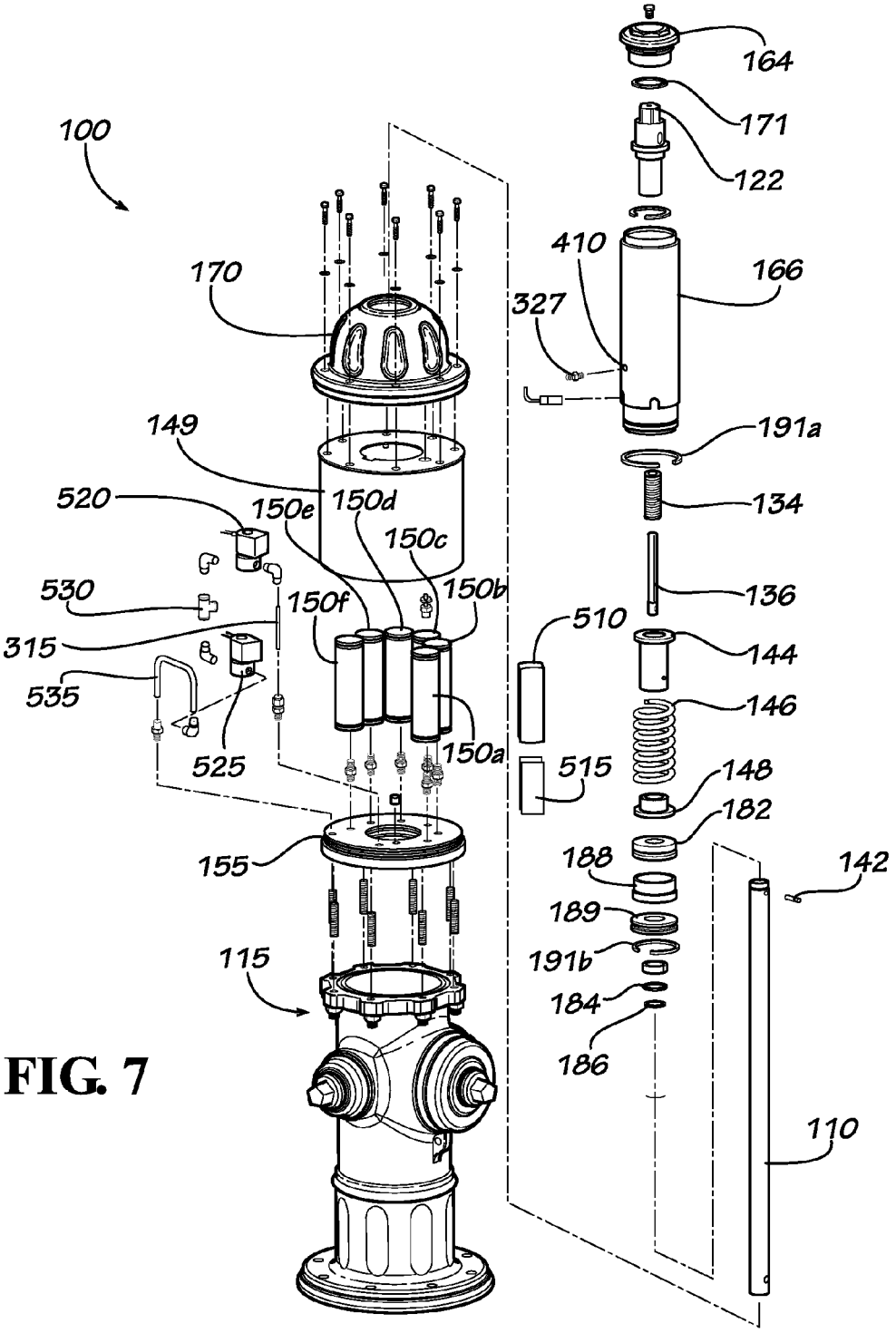
FIG. 7 is an exploded perspective view of the flushable hydrant of FIG. 2.

An exploded view of the flushable hydrant 100 is seen in FIG. 7. In addition to features of the current embodiment that have already been mentioned, the exploded view of the flushable hydrant 100 also shows bolts holding the flushable hydrant 100 together, among other various features.

Figure 8:
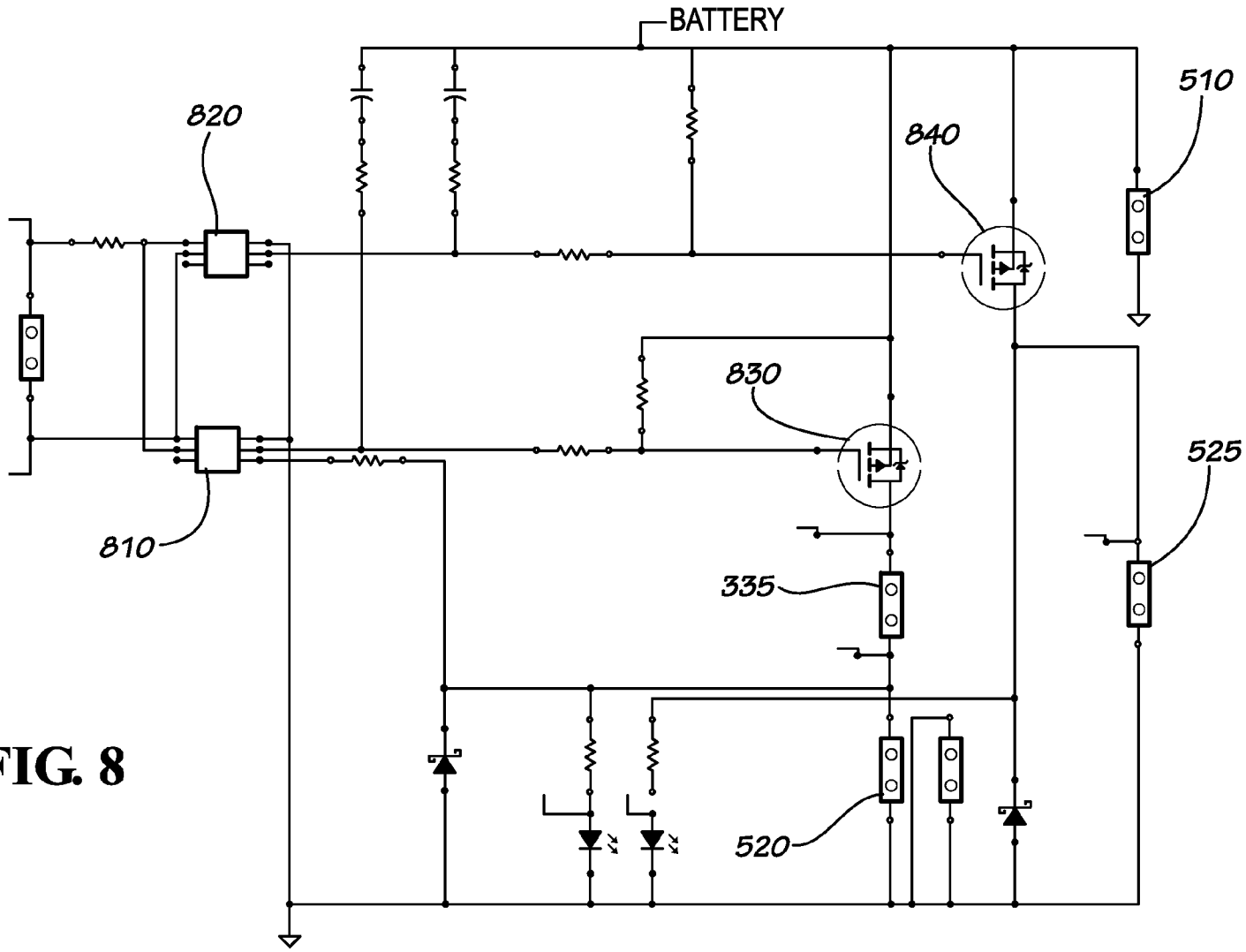
FIG. 8 is an electrical schematic of the flushable hydrant of FIG. 2.

An electrical schematic can be seen in FIG. 8. The electrical schematic of FIG. 8 is but one method of compiling the circuitry to achieve the desired result, and one of skill in the art would understand that variations to such an arrangement may be possible in various embodiments.

In the current embodiment, each of the inflow valve 520 and the outflow valve 525 are operational as electrical latching solenoids, although various types of pressure regulation mechanisms may be present in various embodiments. Each of the inflow valve 520 and the outflow valve 525 are normally closed in the current embodiment.

A first isolator 810 and second isolator 820 provide circuit isolation depending on the direction of current into the system. When current flows in one direction, one circuit is activated; when current flows in the opposite direction, another circuit is activated. As such, the electrical configuration of the current embodiment does not operate both the inflow valve 520 and the outflow valve 525 at the same time, although one of skill in the art would understand that a simple modification would allow such a configuration.

A switch 830 is controlled by the first isolator 810. Switches 830, 840 are electrical switches in the current embodiment, such as transistors. Various embodiments may include variations of switches, including both electrical and mechanical switches. When it is desired to open the inflow valve 520, current flows through the first isolator 810 and closes the switch 830, allowing current to flow across the switch 830. The current is allowed to flow through the proximity sensor 335 when the proximity sensor 335 is not activated. In other words, the proximity sensor 335 is normally shorted. The flowing current activates the inflow valve 520, causing it to open, as described above. The first isolator 810 receives a feedback from the circuit to remain on so long as the proximity sensor 335 is shorted. This action provides the electrical latching of the solenoid in the inflow valve 520.

As described above, the opening of the inflow valve 520 causes the piston plate 182 to travel in front of the proximity sensor 335. When this occurs, the proximity sensor 335 is activated and provides an open in the circuitry. The feedback to the first isolator 810 is cut, and the switch 830 opens, deactivating the inflow valve 520 and retuning the solenoid in the inflow valve 520 to its normally closed position.

When it is desired to open the outflow valve 525, current flows the opposite direction and activates the second isolator 820, thereby closing a switch 840 and allowing current to flow to the outflow valve 525. Because no proximity sensor is used with the outflow valve 525, the system simply opens the outflow valve 525 for a preset duration using an RC (resistor-capacitor) configuration. In the current embodiment, the duration that the outflow valve 525 is opened is a few seconds, although various time durations may be used in various embodiments. Once the timing of the RC current has expired, the switch 840 opens, stopping current flow to the outflow valve 525. When power to the solenoid of the outflow valve 525 is stopped, the outflow valve 525 returns to its normally closed position. Various electronic circuitry that is shown but not described would be understood by one of skill in the art.

It should be emphasized that the embodiments described herein are merely possible examples of implementations, merely set forth for a clear understanding of the principles of the present disclosure. Many variations and modifications may be made to the described embodiment(s) without departing substantially from the spirit and principles of the present disclosure. For example, compressed gas is but one method of actuation among many, including hydraulic, electromechanical, and gravitational, among others. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

One should note that conditional language, such as, among others, "can," "could," "might," or "may," unless specifically stated otherwise, or otherwise understood within the context as used, is generally intended to convey that certain embodiments include, while alternative embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

What is claimed is:

1. A device for flushing a hydrant, comprising:

a stem connectable with a valve of the hydrant and positionable within an interior of the hydrant defined by a barrel and a bonnet of the hydrant, the stem extending through the barrel and the bonnet of the hydrant;

an actuation system including a biased translational system coupled to the stem such that the stem is biased towards a closed position; and a manual override system including a nut coupled to an actuator, the nut including an interface portion and a body portion, the body portion defining a cavity, a surface of the cavity coupled to the actuator, the actuator coupled to the nut such that the actuator is vertically movable relative to the nut, the actuator freely movable relative to the stem and engageable with the stem to manually open and close the valve, the actuator defining a bore, wherein a piston is vertically positionable within the bore defined by the actuator, the piston coupled to the stem and uncoupled from the actuator.

2. The device of claim 1, wherein the actuation system includes at least one of an outflow valve and an inflow valve.

3. The device of claim 1, wherein the actuation system includes a hold down assembly, the hold down assembly including a stem body coupled to the stem.

4. The device of claim 3, wherein the stem body includes an inner surface defining a pressure cavity.

5. The device of claim 3, wherein the hold down assembly further comprises a hold down nut threadedly connected to the stem body, the stem body and the hold down nut configured to engage a bonnet of the hydrant.

6. The device of claim 4, wherein the stem body includes a piston assembly within the pressure cavity, the piston assembly including a piston plate.

7. The device of claim 6, wherein the piston plate is configured to engage the stem and actuate the valve of the hydrant.

8. The device of claim 1, wherein the biased translation system includes a biasing element.

9. The device of claim 8, wherein the biasing element is a spring, the spring surrounding the stem.

10. The device of claim 8, wherein the biased translation system further comprises a top stop coupled to the stem, the top stop engaging an end of the biasing element.

11. The actuation system of claim 1, further comprising a remote communicator operably connected to the actuation system.

12. The actuation system of claim 1, further comprising at least one gas container.

13. The device of claim 1, wherein the actuator and the piston are rotationally fixed.

14. The device of claim 1, wherein the bore and an upper portion of the piston engaging the bore are square in cross-section.

15. The device of claim 1, wherein the actuator is configured to translate along a center axis of the bore as the nut is rotated.

16. The device of claim 1, wherein the valve of the hydrant is selectively positionable about and between an open position and a closed position, the open position allowing a first fluid to flow into the hydrant, the valve selectively positionable by actuating the stem.

17. The device of claim 1, wherein the actuation system further comprises a proximity sensor configured to monitor a position of a piston plate mounted on the stem, the proximity sensor operably connected to a circuit.

18. The device of claim 1, wherein the piston is coupled to the stem by a shear pin.

19. The device of claim 1, wherein a remote communicator is operably coupled to the actuation system, the remote communicator configured to remotely operate the actuation system.

20. The device of claim 1, wherein the actuation system further comprises a battery.

* * * * *